United States Patent [19]

Fantuzzo et al.

[11] Patent Number: 4,754,305

[45] Date of Patent: Jun. 28, 1988

[54] CORONA DISCHARGE DEVICE

[75] Inventors: Joseph Fantuzzo, Webster; Richard A. Noujaim; Henry R. Till, both of Rochester, all of N.Y.

[73] Assignee: Xerox Corporation, Stamford, Conn.

[21] Appl. No.: 548,052

[22] Filed: Nov. 2, 1983 (Under 37 CFR 1.47)

[51] Int. Cl.[4] ..... G03G 15/02

[52] U.S. Cl. ..... 355/3 CH; 355/14 CH; 250/324; 250/325; 250/326

[58] Field of Search ..... 361/229; 250/324, 325, 250/326; 355/3 CH, 14 CH

[56] References Cited

U.S. PATENT DOCUMENTS 3,936,635 2/1976 Clark ..... 361/229

4,265,990 5/1981 Stalka et al. ..... 430/59

*Primary Examiner*—A. C. Prescott

*Assistant Examiner*—D. Warren

[57] ABSTRACT

A corona discharge device including a throw-away subassembly which is inexpensive and can therefore be discarded when it becomes ineffective for its intended purpose. The subassembly can be readily installed into the printing machine in which it is used. It comprises a generally rectangular-shaped insulative frame and a tungsten wire. When the subassembly is inserted into the machine, it cooperates with a generally U-shaped, conductive shield which is an integral part of the machine to form the corona discharge device.

1 Claim, 4 Drawing Sheets

CORONA DISCHARGE DEVICE

This invention relates to the art of printing of the type where images are formed on a charge-retentive surface and more particularly it relates to corona discharge devices for use therein.

In printing arts of the type contemplated, a charge-retentive surface such as a photoconductor which comprises a phoconductive insulating material adhered to a conductive backing is charged uniformly. Then the photoreceptor is exposed to a light image of an original document to be reproduced. The latent electrostatic images, thus formed, are rendered visible by applying any one of numerous pigmented resins specifically designed for this purpose. In the case of a reusable photoreceptor, the pigmented resin, more commonly referred to as toner which forms the visible images is transferred to plain paper. After transfer toner images are made to adhere to the copy medium usually through the application of heat and pressure by means of a roll fuser.

The aforementioned uniform charge is created most commonly by means of a corona discharge device comprising a relatively thin wire usually fabricated from tungsten. The wire is supported between insulative end blocks and is electrically biased to a predetermined voltage, the voltage being one of various values depending on the specific function to be performed (i.e. charging, transfer, etc.). The wire is supported within a channel-shaped shield which can be either insulative or conductive and which can be biased or unbiased.

The wire used in these devices has a diameter on the order of 0.0035 and is quite fragile. Replacement of a broken wire is complicated and cannot be installed by the customer. Thus, a service call has to be made by a trained technician for such installation.

Heretofore, the complete corona device has been rather expensive, therefore, discarding it and replacing it with a new one rather then sending it back to the factory is an expensive proposition.

In view of the foregoing, it will be appreciated that a corotron wire that can be installed by the customer is desirable. Moreover, a corotron device that is cheap enough to discard when it is no longer useful (i.e. when the wire has broken) is also desirable.

In accordance with the present invention, there is provided a corotron which comprises a number of components which are permanently installed in the printing machine in which the device is used while other parts are adapted to be readily removable.

The removable ones are relatively inexpensive and can therefore be discarded when they are no longer useful. To this end a wire is attached to an insulative frame which has a generally rectangular shape with an open in the center thereof. The wire is attached to the end position of the frame and is positioned in the opening. This subassembly of the wire and frame can be very simply installed into the machine by inserting a pair of electrical connector pins or studs forming an integral part of the machine into attachment means carried by the end positions of the machine. The frame and wire assembly are installed such that a generally U-shaped conductive shield which forms an integral part of the machine surrounds the corotron wire.

Other aspects of the present invention will become apparent as the following description proceeds with reference to the drawings.

Inasmuch as the art of electrophotographic printing is well known, the various processing stations employed in the printing machine illustrated in FIG. 1 will be described only briefly.

Figure 1:
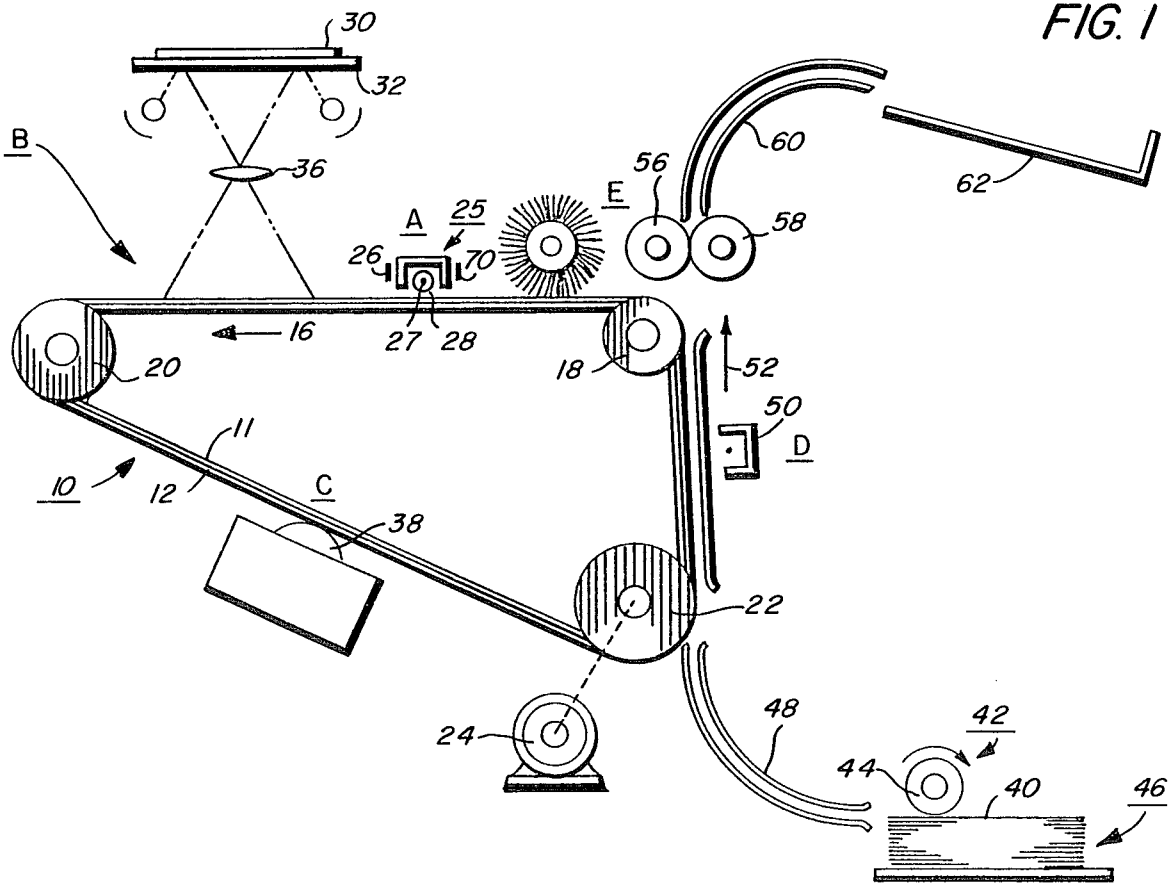
FIG. 1 is a schematic elevational view depicting an electrophotographic printing machine incorporating the present invention.

As shown in FIG. 1, the printing machine utilizes a photoconductive belt 10 which consists of an electrically conductive substrate 11, a charge generator layer 12 comprising photoconductive particles randomly dispersed in an electrically insulating organic resin and a charge transport layer (not shown) comprising a transparent electrically inactive polycarbonate resin having dissolved therein one or more diamines. A photorecptor of this type is disclosed in U.S. Pat. No. 4,265,990 issued May 5, 1981 in the name of Milan Stolka et al, the disclosure of which is incorporated herein by reference. Belt 10 moves in the direction of arrow 16 to advance successive portions thereof sequentially through the various processing stations disposed about the path of movement thereof.

Belt 10 is entrained about stripping roller 18, tension roller 20 and drive roller 22. Roller 22 is coupled to motor 24 by suitable means such as a drive chain.

Belt 10 is maintained in tension by a pair of springs (not shown) resiliently urging tension roller 20 against belt 10 with the desired spring force. Both stripping roller 18 and tension roller 20 are rotatably mounted. These rollers are idlers which rotate freely as belt 10 moves in the direction of arrow 16.

With continued reference to FIG. 1, initially a portion of belt 10 passes through charging station A. At charging station A, a corona device, indicated generally by the reference numeral 25, charges layer 12 of belt 10 to a relatively high, substantially uniform negative potential. A suitable corona generating device for negatively charging the photoreceptor belt 10 comprises a conductive shield 26 and corona wire 27 the latter of which is coated with an electrically insulating layer 28 having a thickness which precludes a net dc corona current when an a.c. voltage is applied to the corona wire when the shield and photoreceptor surface are at the same potential.

Next, the charged portion of the photoreceptor belt is advanced through exposure station B. At exposure station B, an original document 30 is positioned face down upon a transparent platen 32. The light rays reflected from original document 30 form images which are transmitted through lens 36 the light images are projected onto the charged portion of the photoreceptor belt to selectively dissipate the charge thereon. This records an electrostatic latent image on the belt which corresponds to the informational area contained within original document 30.

Thereafter, belt 10 advances the electrostatic latent image to development station C. At development station C, a magnetic brush developer roller 38 advances a developer mix (i.e. toner and carrier granules) into contact with the electrostatic latent image. The latent image attracts the toner particles from the carrier granules thereby forming toner powder images on the photoreceptor belt.

Belt 10 then advances the toner powder image to transfer station D. At transfer station D, a sheet of support material 40 is moved into contact with the toner powder images. The sheet of support material is advanced to transfer station D by a sheet feeding apparatus 42. Preferably, sheet feeding apparatus 42 includes a feed roll 44 contacting the upper sheet of stack 46.

Feed roll 44 rotates so as to advance the uppermost sheet from stack 46 into chute 48. Chute 48 directs the advancing sheet of support material into contact with the belt 10 in a timed sequence so that the toner powder image developed thereon contacts the advancing sheet of support material at transfer station D.

Transfer station D includes a corona generating device 50 which sprays ions of a suitable polarity onto the backside of sheet 40 so that the toner powder images are attracted from photoconductive belt 10 to sheet 40. After transfer, the sheet continues to move in the direction of arrow 52 onto a conveyor (not shown) which advances the sheet to fusing station E.

Fusing station E includes a fuser assembly, indicated generally by the reference numeral 54, which permanently affixes the transferred toner powder images to sheet 40. Preferably, fuser assembly 54 includes a heated fuser roller 56 adapted to be pressure engaged with a back-up roller 58 with the toner powder images contacting fuser roller 56. In this manner, the toner powder image is permanently affixed to sheet 40. After fusing, chute 60 guides the advancing sheet 40 to catch tray 62 for removal from the printing machine by the operator.

Figure 2:
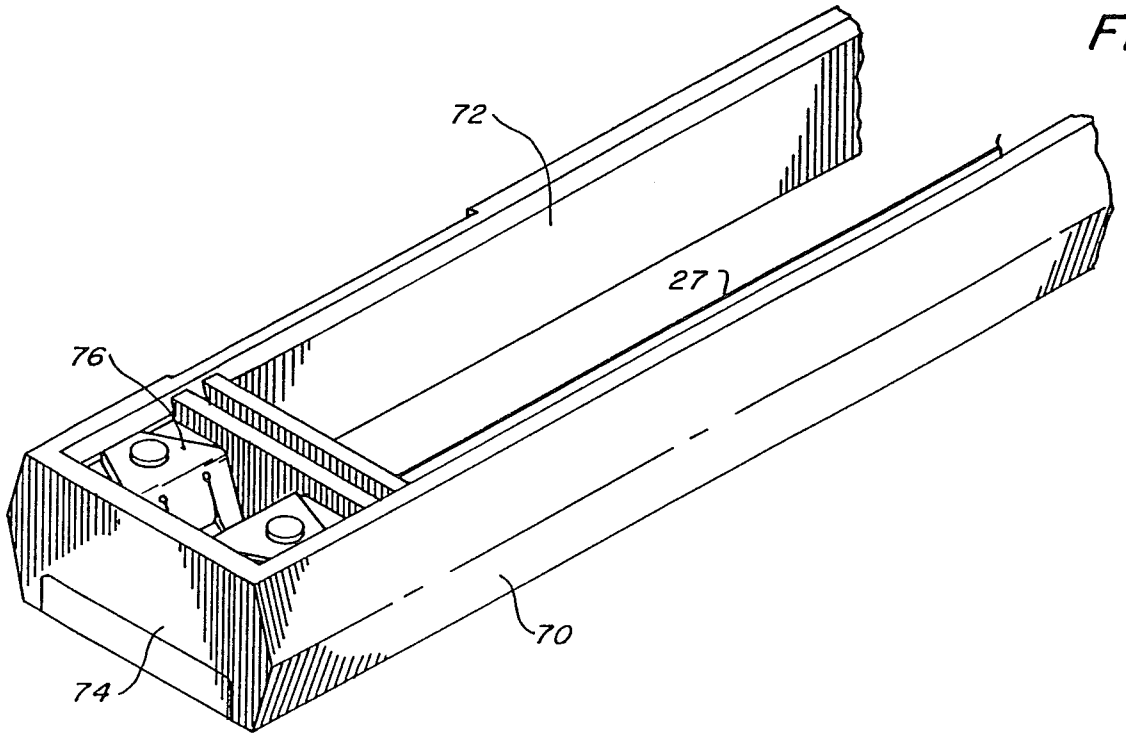
FIG. 2 is a perspective view of a corotron subassembly.
Figure 3:
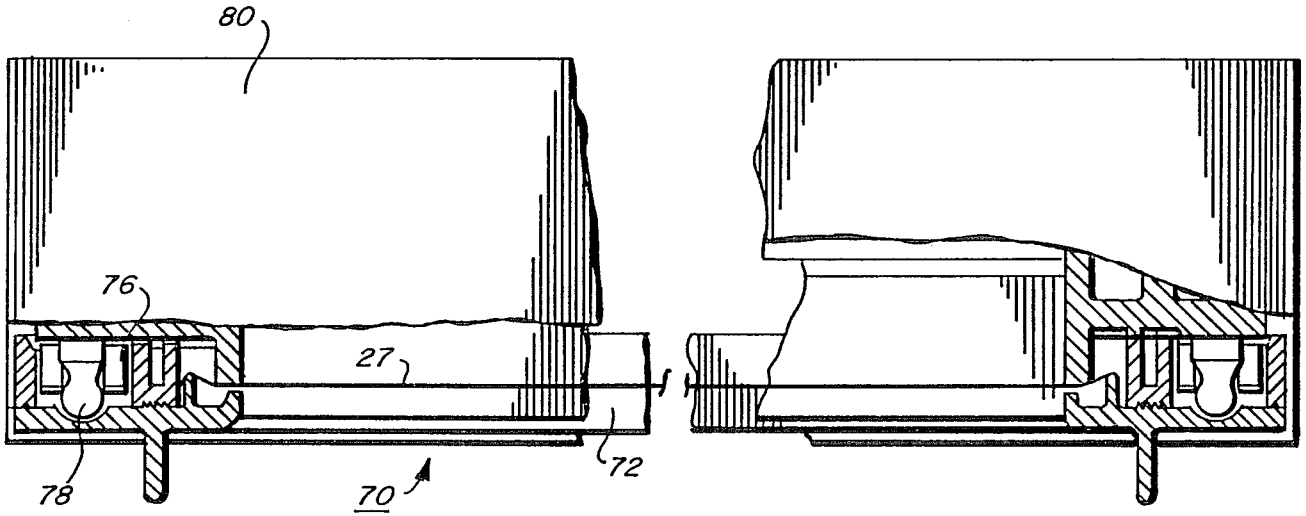
FIG. 3 is a cross-sectional view of the corotron subassembly of FIG. 2 installed in the machine illustrated in FIG. 1.

As illustrated in FIG. 2 the corona discharge device 25 comprises a subassembly 70 including an insulative, generally rectangular-shaped frame member 72. The corona wire 27 is permenantly secured to the frame member such that together with the frame member and a pair of corotron caps to be discussed hereinafter they form the subassembly 70 is formed. Each end portion 74 of the structure 70 has secured thereto a clip member 76 adapted to receive a ball stud 78 forming an integral part of an optics module 80 (see FIG. 3). Thus, the subassembly can be readily attached to and detached from the optics module 80 which forms a permanent part of the machine.

Figure 4:
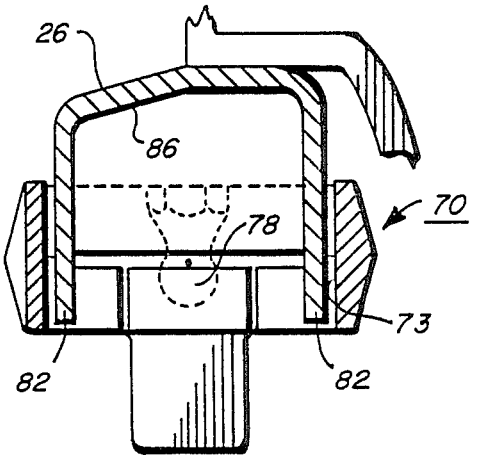
FIG. 4 is an end sectional view of the corotron subassembly rotated 90 degrees from the view shown in FIG. 3.

Once installed, the subassembly cooperates with the generally, U-shaped conductive shield 26 to form the corona discharge device 25. As can be seen in FIG. 4, when the subassembly 70 is in place, leg portions 82 of the U-shaped shield are disposed intermediate side walls 84 of the frame 72 and the corona wire 27, the wire being suitably spaced from the leg portions 82 and a top wall 86 of the shield to produce the desired distribution of current flow between the wire and the shield and between the wire and the photoconductive belt 10.

In order to attach the ends of the corona wire 27 to the ends 74 of the frame, a pair of corotron end caps 88 are provided. The end caps have formed therein saw teeth 90 and a V-shaped groove 92 which mate with saw teeth 94 and 96 formed in the frame ends (see FIG. 5). The corona wire is installed in the frame 72 by first captivating one end thereof between the mating saw teeth of one of the frame ends and one of the caps. In a conventional manner a union is created between the frame and the cap by subjecting them to a solvent capable of effecting a solvent bond therebetween. After the one end of the wire is secured, the wire is pre-tensioned in a well known manner to approximately 0.27 pounds. With the one end of the wire secured and the wire subjected to the aftermentioned pre-tension, the other end of the wire is captivated between the other frame end and the other end cap with subsequent solvent bonding thereof.

Figure 5:
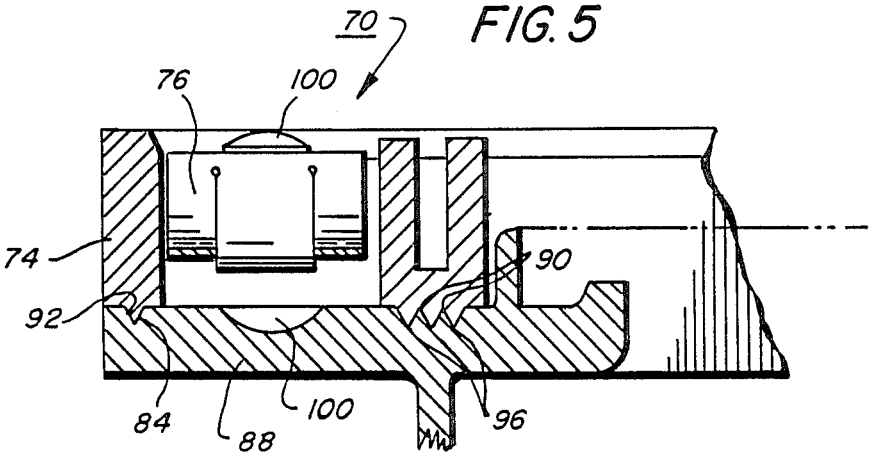
FIG. 5 is an enlarged fragmentary sectional view of the corotron subassembly including an end cap which captivates the corona wire.

In a well known manner a suitable voltage is applied to the corona wire 27 in order effect corona discharge therefrom. To this end, one end of a conductor (not shown) is inserted between the frame ends and the end caps in contact with the ends of the corona wire prior to solvent bonding. As can be seen in FIG. 5 the other end of each conductor 98 is captivated under the head of a rivet 100 which also attaches the aforementioned clip to the frame end. Current to the wire is provided via the belt studs 78.

As can be seen, there has been provided a corotron subassembly which is simple in construction, inexpensive and which can readily be installed. Thus, the subassembly does not require the services of a trained technician and it can be discarded without incurring a great expense.

We claim:

1. Printing apparatus including a charge-retentive surface on which latent electrostatic images are formed, said apparatus comprising:

a generally u-shaped electrically conductive shield forming an integral part of said printing apparatus;

a substantially rectangular-shaped, insulative frame member having end portions and side walls delineating an open area through which portions of said conductive shield can extend upon insertion of said frame member into said apparatus;

a corona wire secured to said end portions and extending therebetween;

said conductive shield and said frame member with said corona wire forming a corona discharge device for use with said charge-retentive surface;

cap members secured to said frame member at said end portions with said corona wire being captivated therebetween;

one part of attaching means caried by said end portions and another part of attaching means forming an integral part of said apparatus, said one part receiving said another part forming an integral part of said printing apparatus; and electrically conducting means connecting the ends of said wire with said attaching means.

* * * * *